US005424163A

United States Patent [19]

Tokunaga et al.

[11] Patent Number: 5,424,163

[45] Date of Patent: Jun. 13, 1995

[54] PICTURE RECORDING METHOD USING A DISPERSANT HAVING COLORING AGENT PARTICLES CONTAINED THEREIN

[75] Inventors: Hiroshi Tokunaga, Tokyo; Akira Shirakura, Kanagawa; Hideki Matsuzaka, Kanagawa; Yuichirou Ikemoto, Kanagawa; Toshimi Fukuoka, Kanagawa; Takashi Mori; Norikazu Iwasaki, both of Tochigi; Yuji Yakura, Kanagawa; Hisashi Andoh, Tochigi; Koichi Kawasumi, Kanagawa, all of Japan

[73] Assignee: Sony Corporation, Tokyo, Japan

[21] Appl. No.: 327,217

[22] Filed: Oct. 21, 1994

Related U.S. Application Data

[63] Continuation of Ser. No. 70,317, filed as PCT/JP92/01282, Oct. 2, 1992, abandoned.

[30] Foreign Application Priority Data

Oct. 3, 1991 [JP] Japan ..... 3-281922

[51] Int. Cl.[6] ..... G03G 13/20; G03G 9/08; G03G 13/14

[52] U.S. Cl. ..... 430/124; 430/99; 430/117; 430/126

[58] Field of Search ..... 430/99, 117, 124, 126

[56] References Cited

U.S. PATENT DOCUMENTS

| | | | |
|---|---|---|---|
| 3,652,319 | 3/1972 | Amidon et al. | 117/37 |
| 4,448,872 | 5/1984 | Vandervalk | 430/126 |
| 4,698,290 | 10/1987 | Berkes | 430/126 |
| 5,037,718 | 8/1991 | Light et al. | 430/126 |
| 5,200,285 | 4/1993 | Carrish | 430/126 |
| 5,229,235 | 7/1993 | Watanabe et al. | 430/117 X |

FOREIGN PATENT DOCUMENTS

| | | | |
|---|---|---|---|
| 0078476 | 5/1983 | European Pat. Off. | 430/126 |
| 44-16473 | 7/1969 | Japan . | |
| 56-151970 | 11/1981 | Japan | G03G 15/14 |
| 57-17962 | 1/1982 | Japan | G03G 15/00 |
| 58-105178 | 6/1983 | Japan | G03G 15/20 |
| 58-184154 | 10/1983 | Japan | G03G 13/00 |
| 59-37578 | 3/1984 | Japan | G03G 15/20 |
| 59-90856 | 5/1984 | Japan | G03G 7/00 |
| 61-126566 | 6/1986 | Japan | G03G 13/01 |

*Primary Examiner*—Marion E. McCamish
*Assistant Examiner*—Bernard Codd
*Attorney, Agent, or Firm*—W. Patrick Bengtsson; Limbach & Limbach

[57] ABSTRACT

An electrostatic latent image is formed by the Carlson process, etc. on a base (photosensitive body) to develop the electrostatic latent image by a solidification developer in which coloring agent particles are dispersed into a dispersion medium in a solid state at an ordinary temperature and adapted to reversibly repeat fusion by heating at about 30° C. at a temperature above a melting point and solidification by cooling, thus to form a developer picture. Thereafter, the base and a transferred body are caused to be subjected to pressure-contact and heating process to fuse the dispersion medium at a pressure-contact and heating temperature more than the melting point of the dispersion medium to subsequently cool the dispersion medium down to a temperature less than the melting point to peel the transferred body to transfer the developer picture onto the transferred body. Alternatively, the dispersion medium is softened at a pressure-contact and heating temperature set so that this temperature falls within a range where it is not above the melting point to subsequently peel the transferred body to transfer the developer picture onto the transferred body. On the surface of a recording paper, a resin layer compatible with a dispersion medium of a developer may be formed.

7 Claims, 7 Drawing Sheets

PICTURE RECORDING METHOD USING A DISPERSANT HAVING COLORING AGENT PARTICLES CONTAINED THEREIN

This is a continuation of application Ser. No. 08/070,317, filed as PCT/JP92/01282, Oct. 2, 1992, now abandoned.

TECHNICAL FIELD

This invention relates to a picture recording method for carrying out printing or picture printing on the basis of a picture signal.

BACKGROUND ART

For example, in printer devices, etc. for use in computers or word processors, various printing systems have been proposed. A thermal transfer recording system is one of these printing systems.

This thermal transfer recording system is uses a thermal transfer ribbon having a thermal fusible ink as an ink layer, and its transfer principle is as follows.

First, a thermal transfer ribbon on which a thermal fusible ink in a solid state at room temperature is coated on a base is caused to be tightly in contact with a transferred paper by pressing force of a thermal head. At this time, the thermal fusible ink which is in a solid state at room temperature is softened and fused by heat of the thermal head. Then, the thermal transfer ribbon is peeled off from the transferred paper when the ink is brought to the solid state for a second time. As a result, the thermal fusible ink at the softened/fused portion is transferred onto the transferred paper. Thus, print, etc. is formed on the transferred paper.

Although, the above-described thermal transfer recording system can simplify the device configuration, and is thus very useful for providing a compact and low cost printer device, it has the following drawbacks.

First, the thermal transfer recording system can only perform binary recording and cannot form graduated images. This is not a significant problem in the case of carrying out only printing, but constitutes a great obstacle in the case of forming a picture (pictorial image).

Further, the recording energy is a large value of 4~6 J/cm$^2$, and the speed is also low. Furthermore, the thermal transfer recording system has a limited pixel density. (In the existing technology, the pixel density of the thermal head has a limit of about 300 dpi).

In addition, there are many problems in view of the running cost and the environmental protection, etc. Namely, an ink of a non-picture portion of the thermal fusible ink is left in the ink ribbon as it is, but the ink remaining in the thermal transfer ribbon cannot be repeatedly used. Accordingly, the greater part of the ink is subjected to disposal. This leads to an increase in the running cost, and results in the possibility that environmental destruction may take place.

On the other hand, as a system for recording a picture, there is also known a system of developing an electrostatic latent image formed on a photosensitive body by a developer in which toners including coloring agent particles are dispersed in a liquid state in an electric insulating dispersion medium. This is called an electrophotographic process. In accordance with the wet developing method, resolution and gradation comparable to silver salt photography can be provided. Especially, a wet developing process using a solidification developer, in which a dispersion medium in a solid state below 30° C. and adapted so that it is fused (molten) by heating and is solidified by cooling is caused to be in a heated and fused state to carry out the wet development is very excellent in view of stability of preservation or handling property, etc. of a developer.

However, in the case of formation of a pictorial image by the above-mentioned wet developing method using solidification developer, there is the problem that transfer of a pictorial image is difficult.

For example, the applicant of this application has already proposed, in the Japanese Patent Application Laid Open No. 81073/1990 publication, a method of heating a developer pictorial image (picture) including a coloring agent (or toner) and a dispersion medium on a base (e.g., a photosensitive body) to allow a transferred body to be in contact therewith in a fused state, thereby transferring the image, or a method of allowing a developer pictorial image (picture) to be in pressure-contact with a transferred body at the time of cooling and solidification to transfer the image.

However, if a transferred body is caused to be in contact with a base (e.g., a photosensitive body) and is peeled off therefrom when a developer pictorial image (picture) is in a fused state, there is the possibility that such a pictorial image may be disturbed uniform transfer is difficult, so unevenness is often observed. Further, in the case where a developer image is caused to be in pressure-contact with a transferred body at the time of cooling and solidification, the developer image cannot be sufficiently transferred, so the quality of a transferred image is remarkably degraded. In addition, there is also the problem that a recorded pictorial image transferred onto a transferred body lacks abrasion resistance.

As described above, in the-thermal transfer recording system, there are the problems that gradation cannot be obtained, and the resolution is insufficient, etc. On the other hand, in the wet developing system using a solidification developer, difficulty of transfer and insufficient durability of a recorded picture, etc. are great problems. Accordingly, solution of these problems is needed.

In view of this, an object of this invention is to provide a picture recording method in which gradation is obtained in a recorded picture, a picture having a high resolution is obtained, and transferability and durability of a recorded picture are both excellent.

In addition, an object of this invention is to provide a picture recording method in which the recording energy for formation of a picture can be reduced, ink is not wastefully consumed, and the recording speed is extremely high.

DISCLOSURE OF THE INVENTION

To achieve the above-described objects, a picture recording method according to a first invention of this invention comprising the steps of: forming an electrostatic latent image on a base; developing the electrostatic latent image by using a solidification developer in which coloring agent particles are dispersed into a dispersion medium which is in a solid-state below 30° C., and is adapted to reversibly repeat fusing by application of heat at a temperature above a melting point and solidification by cooling to thereby form a developer pictorial image (picture) comprised of the coloring agent particles and the dispersion medium on the surface of the base; thereafter allowing the base and the transferred body to be in pressure-contact with each other to apply heating thereto; fusing the dispersion medium at a pressure-contact and heating temperature above the melting point of the dispersion medium; subsequently cooling the dispersion medium so that its temperature becomes equal to a temperature below the melting point; and thereafter peeling the transferred body from the base to transfer the developer picture on the surface of the base onto the transferred body, thereby recording a picture.

Further, a picture recording method according to a second invention of this invention comprises the steps of forming an electrostatic latent image on a base; developing the electrostatic latent image by using a solidification developer in which coloring agent particles are dispersed into a dispersion medium which is in a solid-state at an ordinary temperature, and is adapted to reversibly repeat fusing by application of heat at a temperature above a melting point and solidification by cooling to thereby form a developer pictorial image (picture) comprised of coloring agent particles and the dispersion medium on the surface of the base; thereafter allowing the base and the transferred body to be in pressure-contact with each other to apply heating thereto; softening the dispersion medium at a pressure-contact and heating temperature set in a range where it is not above the melting point of the dispersion medium; subsequently peeling the transferred body from the base to thereby transfer the developer picture on the surface of the base onto the transferred body, thereby recording a picture.

In this invention, a picture is formed by the wet developing process using a solidification developer. Accordingly, gradation can be provided in a recorded picture. As a result, a resolution far greater than that in the case of a thermal head can be provided. In addition, it is sufficient to use a recording energy for forming a picture on the order of $10^{-6}$ J/cm$^2$.

On the other hand, the solidification developer pictorial image (picture) formed undergoes pressure-contact and heating process at a temperature more than the melting point of the dispersion medium, or at a temperature sufficient for softening the dispersion medium. Thus, a toner image is transferred onto the transferred body substantially by 100%. Since transfer is collectively carried out without using a thermal head, etc., the transfer speed is very high, and sufficient durability is ensured.

In addition, since ink (toner) is used only at necessary portions of a picture, ink is not wastefully consumed. This is advantageous in respect to running cost, or environmental protection, etc.

BEST MODE FOR CARRYING OUT THE INVENTION

A picture formation process in this invention comprises a charging process step, an exposure process step, a development process step, a pressure-contact and heating process step, and a peeling process step. Further, a transferred body undergoes a heat treatment process step according to need so that a recorded picture is provided. On the other hand, a base (photosensitive body) is used in the picture formation process for a second time after undergoing a cleaning process step.

Figure 1:
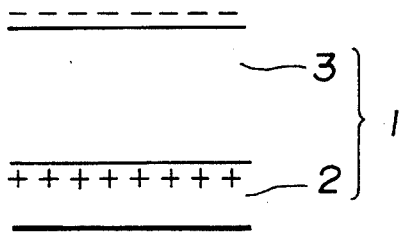
FIG. 1 is a model view showing a charging process.

The charging process step and the exposure process step mentioned above are the same as in the case of an ordinary Carlson method electrophotography. Namely, as shown in FIG. 1, a photosensitive body 1 including a photosensitive layer 3 provided on a conductive base 2 is first charged uniformly minus, for example, by using a suitable charging means such as a corona discharger, etc. at a charging process.

Here, as the photosensitive layer 3 of the photosensitive body 1, well known organic photoconductors or inorganic photoconductors may be used. As the organic photoconductor, for example, an arbitrary material may be selected from well known materials of a broad range. As materials put into practice, there are enumerated an electrophotographic photosensitive base material comprised of poly-N-vinylcarbazole and 2, 4, 7-trinitrofluoren-9-one; material obtained by sensitizing poly-N-vinylcarbazole by using pyrylium salt coloring matter; material obtained by sensitizing poly-N-vinylcarbazole by using cyanine coloring matter; an electrophotographic photosensitive base material including an organic pigment as a major component, an electrophotographic photosensitive base material including, as a major component, eutectic complex comprised of dye and resin, and the like. As the inorganic photoconductor, there are enumerated zinc oxide, zinc sulfide, cadmium sulfide, selenium, selenium-tellurium alloy, selenium-arsenic alloy, selenium-tellurium-arsenic alloy, amorphous silicon material, and the like.

Figure 2:
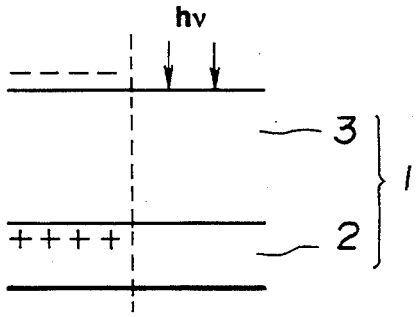
FIG. 2 is a model view showing an exposure process.

In the subsequent exposure process step, selective light irradiation corresponding to picture information is carried out by using suitable exposure means such as a semiconductor infrared laser light source, etc. As a result, minus charges at the exposed portion disappear as shown in FIG. 2. Thus, an electrostatic latent image is formed.

It is to be noted that the above-mentioned electrostatic latent image may be formed on the surface of a dielectric base by the electrostatic system such as the multi-stylus system or the ion-flow system, etc without using a photosensitive body.

Figure 3:
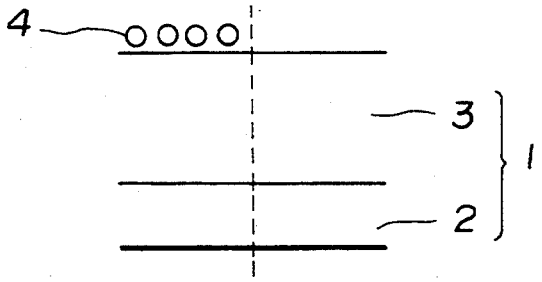
FIG. 3 is a model view showing a development process.

In the above-mentioned development process, the photosensitive body 1 on which the electrostatic latent image is formed as described above is developed by the developer. Thus, developing agent pictorial images 4 including coloring agent particles are formed in correspondence with the electrostatic latent image as shown in FIG. 3.

At this time, as the developer, there is used a solidification developer in which coloring agent particles charged plus are dispersed in an electric insulating dispersion medium in a solid state at an ordinary temperature. This developer is heated and fused by a heating means. The developer is in a liquid state at the time of development, but is solidified for a second time when cooled.

The dispersion medium used in the developer is an electric insulating organic material. Its melting point is set to more than 30 degrees in consideration of an ordinary use environment and handling property, and is more preferably more than 40 degrees. Although the upper limit of the melting point is not particularly limited, it is about 100 degrees in a practical use, and is more preferably less than 80 degrees. This temperature range is employed is allow for the fact that even if the melting point is too high, extra energy is consumed for heating, the fact that in the case where such dispersion medium is used in a manner held on a support body, the melting point does not exceed a heat resistance temperature of a material generally used as a support body, and the like.

As a material of a dispersion medium to satisfy these requirements, there are enumerated paraffin, wax, and mixture of these materials. Initially, as the paraffin, there are various orthoparaffin having the number of carbons of 19 to 60 from nonadecane up to hexacontane. Further, as the wax, there are enumerated plant wax such as carnauba wax, cotton wax, etc., animal wax such as bees wax, etc., ozokerite; petroleum wax such as paraffin wax, microcrystalline wax or petrolatum, etc. These materials are dielectric materials generally having dielectric constant $\epsilon$ of about 1.9 to 2.3. It is to be noted that ethylene polyvinyl acetate copolymer, etc. may be added for the purpose of improving cohesive force of a dispersion medium.

In addition, crystalline polymer may be used having a long alkyl group at the side chain such as homopolymer or copolymer of polyacrylate such as polyethylene, polyacrylamide, poly-n-stearyl acrylate, or poly-n-stearyl methacrylate, etc. (e.g., copoly-n-stearyl acrylate-ethyl methacrylate, etc.), or the like. When viscosity, etc. at the time of heating is taken into consideration, the above-mentioned paraffin and wax are suitable.

Further, with regard to the coloring agent particle dispersed in the electric insulating organic material, inorganic pigment, organic pigment and dye which are conventionally known, and mixture thereof may be used.

For example, as the inorganic pigment, there are enumerated chromium pigment, cadmium pigment, iron pigment, cobalt pigment, ultramarine, prussian blue, etc. Moreover, as the organic pigment and the dye, there are enumerated Hansa Yellow (C.I. 11680), Benzidine Yellow G (C.I. 21090), Benzidine Orange (C.I. 21110), Fast Red (C.I. 37085), Brilliant Carmine 3B (C.I. 16015-Lake), Copper Phthalocyanine Blue (C.I. 74160), Victorian Blue (C.I. 42595-Lake), Spirit Black (C.I. 50415), Oil Blue (C.I. 74350), Alkali Blue (C.I. 42770A), Fast Scarlet (C.I. 12315), Rhodamine 6B (C.I. 45160), Rhodamine Lake (C.I. 45160-Lake), Fast Sky Blue (C.I. 74200-Lake), Nigrosine (C.I. 50415), Carbon Black, etc. The individual materials mentioned above may be used individually or as a mixture of two or more different materials. Any material having a desired color development (coloring) selected may be used.

As the developer, in addition these electric insulating organic materials or coloring agent particles, resin may be used in combination for the purpose of improving dispersion property or charging ability of a coloring agent, etc. As such resin, any one of known materials suitably selected may be used. For example, there are enumerated rubber such as butadiene rubber, styrene-butadiene rubber, cyclized rubber, or natural rubber, etc; synthetic resin such as styrene resin, vinyl toluene resin, acryl resin, methacryl resin, polyester resin, polycarbonate resin or polyvinyl acetate resin, etc.; alkyd resin including colophonium (rosin) resin, hydrogenated colophonium resin, denaturated alkyd such as linseed oil denaturated alkyd resin, etc.; natural resin such as polyterpene, and the like. In addition, phenol resin, denaturated phenol resin such as phenol formalin resin, etc.; pentaerythritol phthalate, cumarone-indene resin, ester gum resin, vegetable oil polyamide resin, and the like are also useful. Further, halogenated hydrocarbon polymer such as polyvinyl chloride, or chlorinated polypropylene, etc.; synthetic rubber such as vinyl toluene-butadiene, butadiene-isoprene, etc.; polymer of acryl monomer having long chain alkyl group such as 2-ethyl hexyl methacrylate, lauryl methacrylate, or stearyl methacrylate, lauryl acrylate, octyl acrylate, etc., or copolymer with other polymeric monomers (e.g., styrene-lauryl methacrylate copolymer, or acrylic acid-lauryl methacrylate copolymer, etc.); polyolefin such as polyethylene, polyterpene, and the like may be used.

Moreover, charge donating agent or donator is ordinarily added to the developer. As the charge donating agent used, there are, for example, metal salt of fatty acid such as naphthenic acid, octenoic acid, oleic acid, stearic acid, isostearic acid, or lauric acid, etc., metal salt of sulfosuccinic acid ester, oil soluble sulfonic acid metal salt, phosphoric acid ester metal salt, metal salt of abietic acid, etc., aromatic carboxylic acid metal salt, or aromatic sulfonic acid metal salt, and the like.

Further, in order to improve electrification charges of the coloring agent particles, metal oxide fine particles such as $SiO_2$, $Al_2O_3$, $TiO_2$, ZnO, $Ga_2O_3$, $In_2O_3$, $GeO_2$, $SnO_2$, $PbO_2$, or MgO, etc., or mixture of these materials may be added as a charge enhancement agent.

Figure 4:
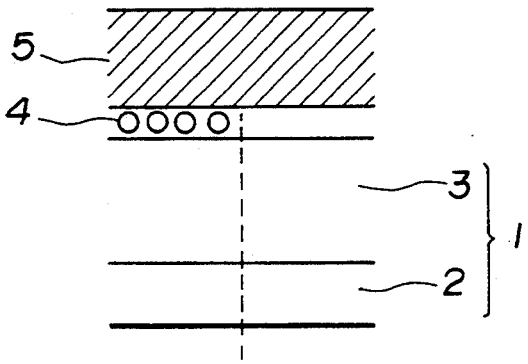
FIG. 4 is a model view showing a transfer process.

After the developer picture 4 is formed by the above-mentioned development process, a transferred body 5 is caused to be superimposed as shown in FIG. 4 to carry out a transfer process step.

It is preferred that a material having a large adhesive force with respect to a solidification developer as described above is employed as a material which can be used as the transferred body. Depending upon use, any material may be suitably selected. As an example, there are various papers such as natural paper, or synthetic paper, etc., cloth or nonwoven fabric cloth comprised of vegetable fiber such as cotton or hemp, etc., or animal fiber such as silk, or wool, etc.; cloth or nonwoven fabric cloth comprised of organic synthetic fiber such as polyamide, polyester, polyacetal, polyurethane, etc. or inorganic fiber such as ceramic or carbon., etc.; polymeric (high molecular) foaming agent, e.g., mesh or polyurethane form, etc. such as metal or organic high polymer, etc. In order to preserve a picture in the form of an ordinary document, it is preferable to use white paper, etc. as a transferred body in order to enhance visibility. However, it is a matter of course that the transferred body is not limited to such white paper.

It is to be noted that a resin layer compatible with a dispersion medium of the solidification developer may be formed on the surface of the transferred body 5 with a view to ensuring an adhesive force with respect to the solidification developer. Thus, transfer of the developer picture 4 can be more reliably carried out.

As the resin constituting a resin layer formed on the surface of the transferred body, any resin which can be compatible with a dispersion medium may be employed. For example, thermal plastic elastomer, low density polyolefin, ionomer resin, polyvinyl acetate copolymerized polyolefin, light molecular weight polyolefin, or adhesive agent for hot melt, etc. may be used. These resin materials are. available on the market as the trade name "Chemipearl" (A type, M type, S type, V type, W type) (all are manufactured by Mitsui Sekiyu Kagaku Company Ltd.,), or the trade name "Aqulift" (manufactured by Sumitomo Kagaku Company Ltd.,).

In the pressure-contact and heating process, e.g., a pressure roller, etc. is used to allow the transferred body 5 to be in pressure-contact with the base (photosensitive body) 1 surface on which the developer picture 4 is formed to apply heating to the entire surface thereof to fuse or soften it. Namely, the entire surface is heated so that its temperature reaches a value more than the melting point of the dispersion medium constituting the developer picture 4 to fuse it, or is heated so that its temperature reaches a value which is not above the melting point and higher than below 30° C.

Thereafter, in the case of the former (in the case where the entire surface is heated to a temperature more than the melting point and is fused), it is cooled so that the temperature of the developer picture 4 is in correspondence with a temperature lower than the melting point for a second time to peel the transferred body 5 therefrom. It is to be noted that cooling may be a natural cooling, or cooling means may be provided to carry out cooling. It is preferable that cooling is carried out through the transferred body. On the other hand, in the case of the latter (in the case where the entire surface is softened at a temperature which is not above the melting point), the transferred body 5 may be peeled as it is, or it may be peeled after temperature is lowered by cooling.

Attention should be drawn to the fact that if the developer picture 4 is not sufficiently solidified in peeling the transferred body 5, cohesive force becomes insufficient and cohesive breakage thus takes place, so the transfer rate does not reach 100%. Further, when heating is applied from the base 1 side in peeling to allow an adhesive force between the base 1 and the developer picture 4 to be weaker than an adhesive force between the transferred body 5 and the developer picture 4, the transfer rate is further improved.

Except for the case where the pressure-contact and heating condition, etc. does not especially require heat treatment, the peeled transferred body 5 is caused to undergo heat treatment at a temperature higher than the pressure-contact and heating temperature irrespective of the temperature upper limit determined by the heat resistance of the base 1, thereby making it possible to enhance a coupling force to the transferred body 5 of a recorded picture thus to improve abrasive resistance. While heat cannot be applied so much to the substrate 1 serving as a photosensitive body, heat can be freely applied to the transferred body 5 after peeling. Namely, it is possible to freely implement the heat treatment. The heat treatment temperature in the heat treatment process is arbitrary. However, in the case where the heat treatment temperature is above the pressure-contact and heating temperature, or a resin layer is formed on the transferred body, it is preferable that the heat treatment temperature is set to a temperature more than the softening temperature of the resin layer. In addition, in the case where the heat treatment process is unnecessary by the pressure-contact and heating condition, etc., the device can become compact.

On the other hand, in the cleaning process step, the remaining solidification developer on the surface of the substrate i is removed, and is subjected to a series of process steps starting with the charging process step for a second time.

The fundamental process in the picture recording method of this invention has been described above, and an example of a device in a more practical form for carrying out the method of this invention will now be described.

Figure 5:
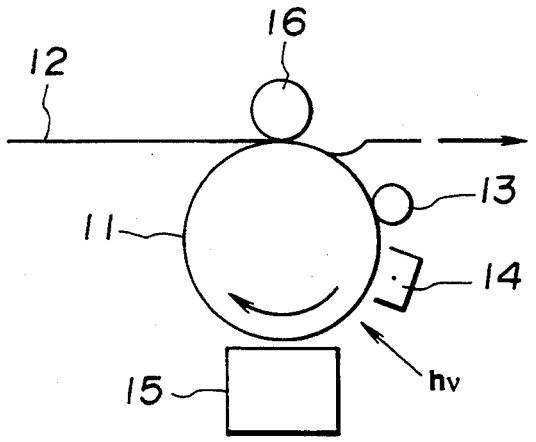
FIG. 5 is a model view showing an example of the configuration of a printer for a monochromatic picture using a drum of a photosensitive body.

FIG. 5 shows a device corresponding to a laser printer for monochromatic picture, which serves to form a picture comprised of the above-described solidification developer on a drum 11 of a photosensitive body (hereinafter referred to as a photosensitive body drum) 11 to transfer it onto a recording paper 12.

Accordingly, around the photosensitive body drum 11, there are arranged a cleaning roller 13, a corona charger 14 for charging, a light source for carrying out exposure process by a laser beam hυ, and a developing unit 15 by the solidification developer. Thus, a picture comprised of a solidification developer is formed in advance on the photosensitive body drum 11.

The recording paper 12 is pressed onto the photosensitive body drum 11 by a heat roller 16. By this pressed portion, the picture comprised of the solidification developer on the photosensitive body drum 11 is fused or softened. Thereafter, the recording paper 12 runs along the photosensitive body drum 11 for a short time. For this time period, the solidification developer picture is cooled and solidified. When the recording paper 12 is away from the photosensitive body drum 11, the solidification developer picture is transferred onto the recording paper 12.

Figure 6:
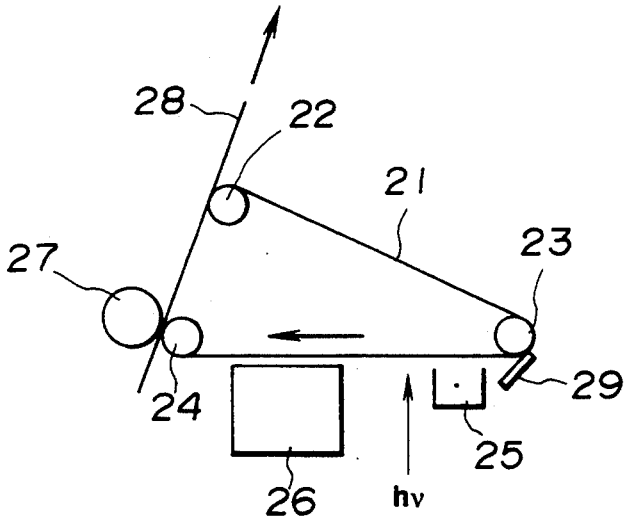
FIG. 6 is a model view showing an example of the configuration of a printer for a monochromatic picture using a belt of a photosensitive body.

FIG. 6 shows an example of a device using a belt of a photosensitive body (hereinafter referred to as a photosensitive body belt) 21 in place of the photosensitive body drum 11.

In this example, a ring-shaped photosensitive body belt 21 is caused to be cyclically run through guide rolls 22, 23, 24. To the surface of the photosensitive body belt 21, charging, exposure, and developing processes are implemented in succession by a corona charger 25, a light source for carrying out exposure process by laser beam hυ, and a developing unit 26 for carrying out developing process by a solidification developer. The developer picture thus formed is similarly transferred onto a recording paper 28 by a heat roller 27. In addition, light is irradiated by a static charge reducing lamp after transfer has been completed. Then, remaining toner is removed by a cleaning blade 29. Thus, the process shifts to the charging process step for a second time.

In this example, since the time period during which the recording paper 28 and the photosensitive body belt 21 run in such a manner that they are in contact with each other is long, the developer picture fused and softened by the heat roller 27 can be sufficiently cooled and solidified. Thus, reliable transfer can be conducted.

Figure 7:
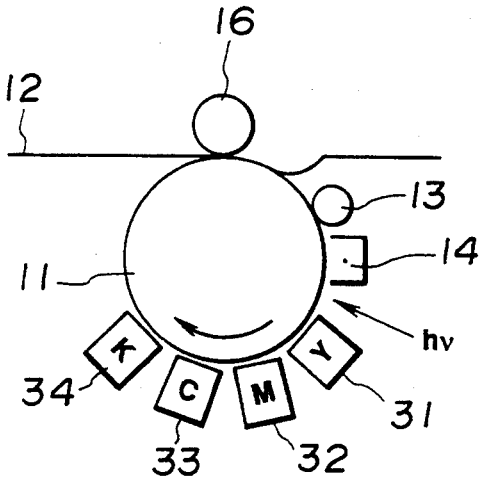
FIG. 7 is a model view showing an example of the configuration of a printer for a color picture using a drum of a photosensitive body.
Figure 8:
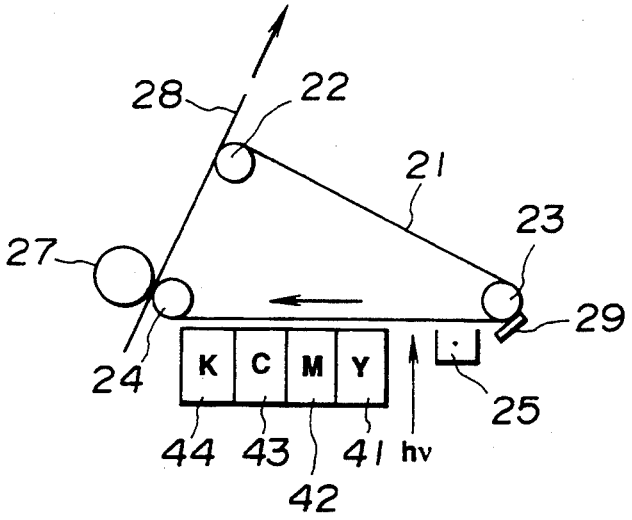
FIG. 8 is a model view showing an example of the configuration of a printer for a color picture using a belt of a photosensitive body.

In the case where the printer is constructed as a color printer, respective color developing units 31, 32, 33 and 34 of yellow (Y), magenta (M) and cyan (C), and black (K) according to need may be arranged around the photosensitive body drum 11 in place of the developing unit 15 in the device shown in FIG. 7. Also in a device using the photosensitive body belt, respective color developing units 41, 42, 43 and 44 of Y, M, C and K may be arranged in succession along the running direction of the photosensitive body belt 21 in place of the developing unit 26 as shown in FIG. 8 in a manner similar to the above.

In the case of a color printer, there are a system in which color superposition of Y, M, C, K is carried out on the photosensitive body to carry out batch transfer, and a system in which Y, M, C, K images are transferred every time to carry out color superposition on a recording paper. Any one of these systems may be employed.

An embodiment in a practical sense to which this invention is applied will now be described in detail with reference to the attached drawings.

Figure 9:
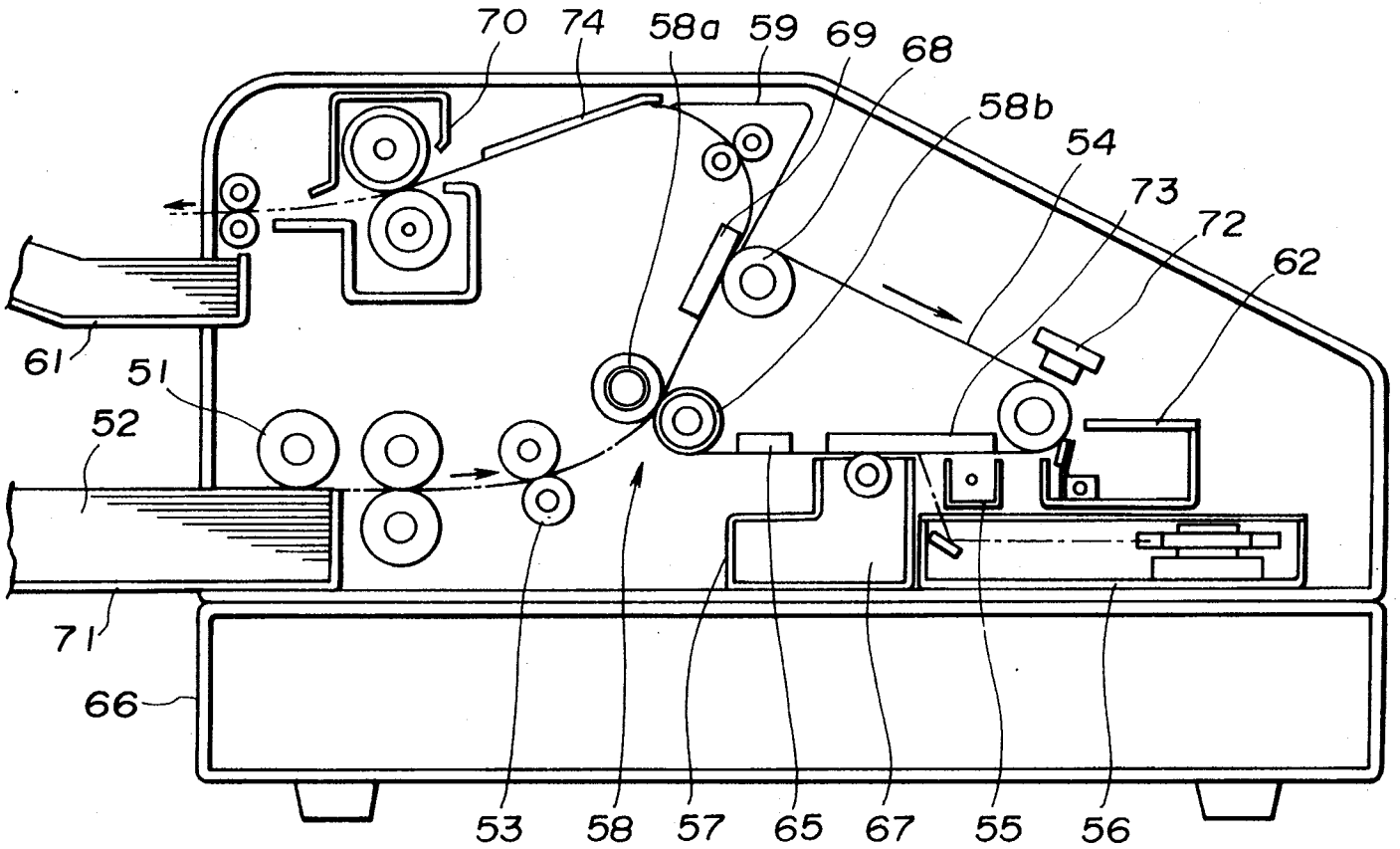
FIG. 9 is a model view showing the configuration of a printer used in the embodiment.

Initially, the configuration of a printer used in the experiment is shown in FIG. 9. This printer includes, within a printer body 66 serving as a casing, a photosensitive body belt 54, a charging exposure unit comprised of an electrification charger 55 and a laser optical system 56, etc., a developing unit 57, and a transfer unit, etc.

A paper feed cassette 71 is detachably loaded into the printer body 66. A developer picture is recorded onto a transfer sheet 52 set within the paper feed cassette 71.

The above-mentioned photosensitive body belt 54 is extending over various rollers which will be described later, and is caused to run in a clockwise direction in the figure. Around the photosensitive body belt 54, there are arranged electrification charger 55, laser optical system 56, developing unit 57, a pressure-contact mechanism 58, a separation unit 59, a static charge reducing lamp 72, and a cleaning unit 62 for repeatedly carrying out a series of processes of charging, exposure, development, transfer, peeling, static charge reduction, and cleaning.

A solidification developer 67 to repeat fusing and solidification by heating and cooling as previously described is delivered to the developing unit 57. This developer 67 is brought into a fused state by heating. Similarly to the case of the wet development using a liquid developer, an electrostatic latent image on the photoconductive body belt 54 is developed.

At the position on the back side opposite to the electrification charger 55, the laser optical system 56 and the developing unit 57 of components constituting the photosensitive body belt 54, a heater 73 for heating the photosensitive body belt 54 is provided. Further, at the position on the exit side of the developing unit 57, a cooling plate 65 (or cooling means such as a cooling roller or a cooling fan, etc.) is provided according to need.

It is to be noted that the reason why the photosensitive body belt is used in place of the photosensitive body drum is that the latter has a smaller calorific or heat capacity and has a more excellent sensitivity with respect to temperature in carrying out cooling/heating process.

On the other hand, the pressure-contact mechanism 58 is comprised of a pressure roller **58*a* and a pressure-contact roller 58*b*, and is of a structure such that the photosensitive body belt 54 is put between the pressure roller 58*a* and the pressure-contact roller 58*b*. The pressure-contact roller 58*b* of these rollers also serves as a guide roller of the photosensitive body belt 54, and the pressure roller 58*a* serves to allow the transfer sheet 52 to be superimposed on the developed photosensitive body belt 54. It is to be noted that in the case where pressure by the transfer sheet 52 itself is sufficient, the pressure roller 58*a*** may be omitted.

At the position where the transfer sheet 52 is peeled from the photosensitive body belt 54, a peeling roller 68 is provided in a manner to be in contact with the back side of the photosensitive body belt 54. This peeling roller 68 functions as a guide roller, so the running direction of the photosensitive body belt 54 is changed. At the position opposite to the peeling roller 68, a cooling plate 69 is provided in a manner to be in contact with the back side of the transfer sheet 52. According to need, the photosensitive body belt 54 is heated by the peeling roller 68, or the transfer sheet 52 is cooled by the cooling plate 69.

In the vicinity of the peeling roller 68, a separation unit 59 such as a separation pawl, etc. is disposed. This separation unit 59 is of such a structure to carry out peeling from the photosensitive body belt 54 of the transfer sheet 52. It is to be noted that in the case where peeling of the transfer sheet 52 is carried out by the curvature separation on the peeling roller 68, the above-mentioned separation unit 59 is unnecessary.

In the advancing direction of the peeled transfer sheet a guide plate 74 and a fixing unit 70 are disposed, and an ejection unit 61 may be disposed according to need so that the transfer sheet 52 can be smoothly ejected. A fixing unit 70 provided in front of the ejection unit 61 is comprised of a thermal roll or a thermal oven, etc., and is of a structure to heat the transfer sheet 52 which has undergone transfer process so that the visible image can be fixed.

It is to be noted that, in the case of heating the roller in a printer of the previously described structure, a roller, etc. included in the heater is used.

In the above-described printer, an electrostatic latent image is formed on the photosensitive body belt 54, and is developed by using the developer 67. Namely, the photosensitive body belt 54 is rotationally driven in a clockwise direction in the figure, and the surface thereof is charged by the electrification charger 55. Then, laser beams from the laser optical system 56 are irradiated thereto to form an electrostatic latent image. This electrostatic latent image is caused to be a visible image by the developer 67 when passed through the developing unit 57.

Thereafter, the temperature of the developer picture 80 is caused to be lower than the melting point of the dispersion medium by the cooling plate 65 (or a cooling roll or a cooling fan) provided inside the photosensitive body belt 54 according to need, thus allowing the developer picture 80 to be in a solid-state.

On the other hand, the transfer sheet 52 is delivered in a direction indicated by an arrow in the figure from the paper feeder 51 to grasp the timing by the resist rollers 53 to convey the transfer sheet 52 to a latent image carrier comprised of the photosensitive body belt 54. Then, the visible image (developer picture 80) comprised of the developer 67 is transferred onto the transfer sheet 52 conveyed to the photosensitive body belt 54 by the pressure-contact unit 58 and the separation and peeling unit 59. Thereafter, the transfer sheet 52 which is tightly in contact with the surface of the photosensitive body belt 54 is mechanically separated.

Transfer is carried out by conveying the photosensitive body belt 54 up to the transfer roll pair 58 entrance with the developed picture being held to allow its timing to be in correspondence with the timing of the transfer sheet 52 to cause it to be tightly in contact therewith to apply pressure and heating (pressure-contact and heating) thereto with the transfer sheet 52 being put between the transfer roller pair 58.

Figure 10A:
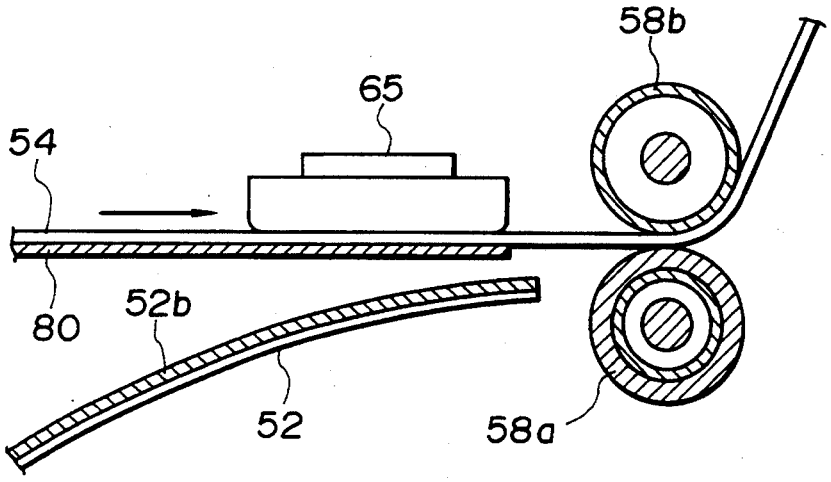
FIGS. 10A and 10B is a schematic cross sectional view of the essential part showing the state where a photosensitive body belt and a transfer sheet are in a pressure-contact state.
Figure 10B:
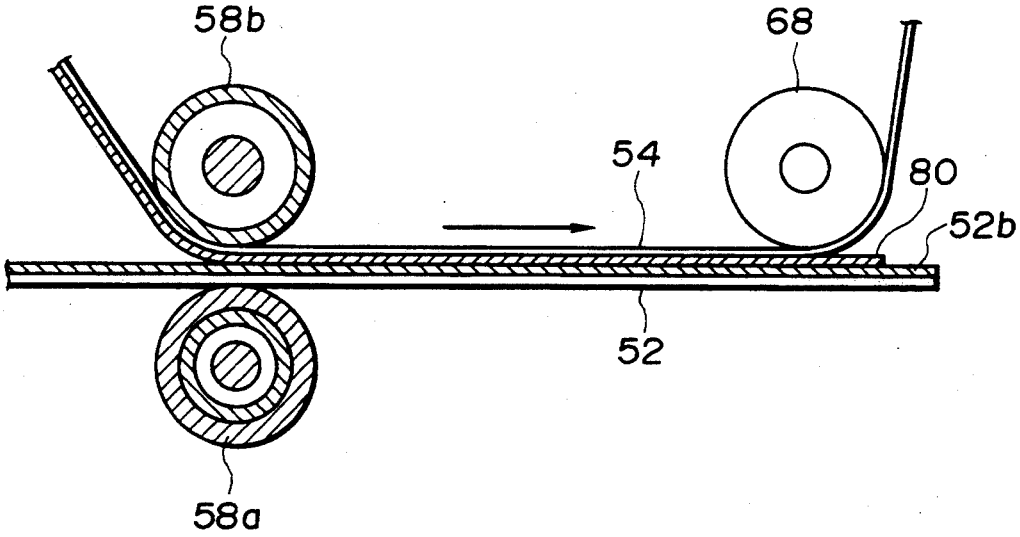

The pressure-contact mechanism (transfer roller pair) 58 is of a structure also as previously described such that the photosensitive body belt 54 is put between the pressure roller 58*a* and the pressure-contact roller 58*b*. As shown in FIGS. 10A and B, by fusing or softening the developer picture 80 by heating applied to the pressure roller 58*a* and the pressure-contact roller 58*b*, transfer is carried out onto the transfer sheet 52.

After pressure-contact process by the pressure-contact mechanism 58, the photosensitive body belt 54 and the transfer sheet 52 are conveyed in the state where they are tightly in contact with each other. On the peeling roller 68, peeling is carried out by the separation unit 59 such as curvature separation or separation pawl, etc. In peeling, an approach may be employed to heat the peeling roller 68 and to cool the transfer sheet 52 from the back side by the cooling plate 69 while at the same time heating the photosensitive body belt 54 from the back, thus allowing a visible image to be peeled off from the photosensitive body belt 54.

Thereafter, the transfer sheet 52 is conveyed to the fixing unit 70. Thus, the visible image on the transfer sheet 52 is fixed by the fixing unit 70, and is then ejected to the ejection unit 61 in a direction indicated by an arrow in the figure.

On the other hand, a residual developer on the photosensitive body belt 54 which has undergone the visible image transfer process is removed by the cleaning unit 62 having a cleaning blade. The developer 67 thus removed is collected into the cleaning unit 62.

In FIGS. 11A, 11B, 11C, 11D, 11E and 11F, a picture formation process in the device of this embodiment is shown as the state of the photosensitive body belt 54, the developer picture 80, and a sheet material 52*a* and a surface resin layer 52*b* of the transfer sheet 52.

Figure 11A:
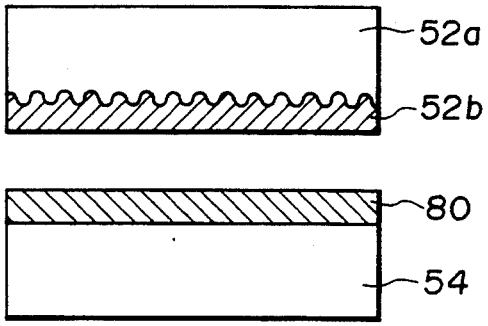
FIGS. 11A, 11B, 11C, 11D, 11E and 11F is a schematic cross sectional view showing, in a model form, the state of a developer and a surface resin layer in the transfer process.

Initially, before transfer, as a matter of course, as shown in FIG. 11A, a developer picture 80 on the photosensitive body belt 54 and the surface resin layer 52*b* (thickness is 0.1~0.08 mm) of the transfer sheet 52 are in a separate state.

Figure 11B:
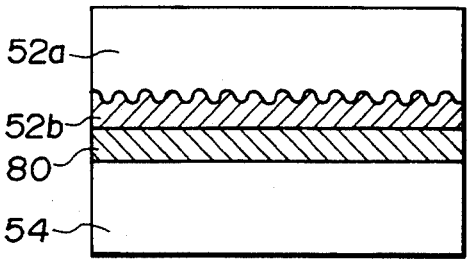
Figure 11C:
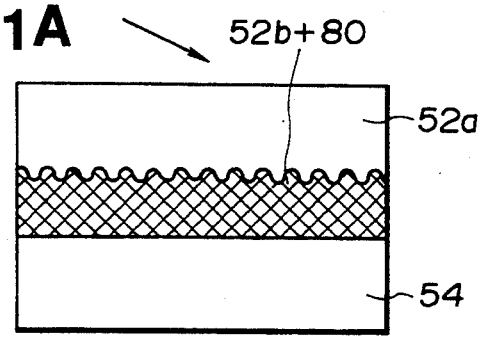

Then, in the transfer process, application of pressure and heating are carried out, and the developer picture 80 and the surface resin layer 52*b* are caused to be in contact with each other. At this time, there results, in dependency upon the heating temperature, an adhesive state where contact portions are stuck as shown in FIG. 11B (a process transferred via such a state will be called an adhesive transfer hereinafter), or a compatible state where those portions are in a compatible state as shown in FIG. 11C (a process transferred via such a state will be called a compatible transfer hereinafter).

Figure 11D:
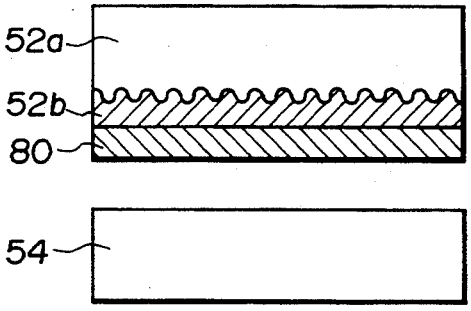
Figure 11E:
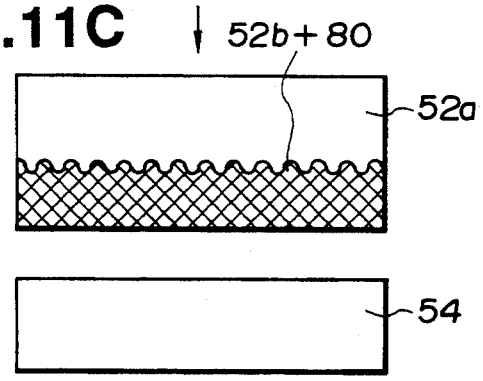

In the peeling process, the temperature of the developer picture 80 is caused to be lower than the temperature at the time of transfer so that there holds a relationship expressed as (adhesive force of the photosensitive body belt and the developer)<(adhesive force of the surface resin layer and the developer)<(cohesive force of the developer) to finely peel the developer picture 80 from the photosensitive body belt 54 as shown in FIGS. 11D or E to transfer it to the transfer sheet 52 side.

Figure 11F:
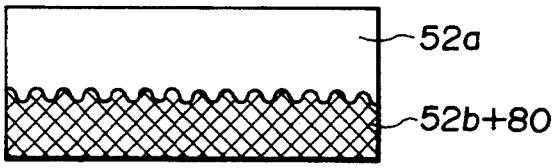

Finally, in the fixing process, according to need, the developer picture 80 and the surface resin layer 52*b* are heated so that its temperature reaches a softening temperature of the surface resin layer 52*b*. Thus, they are caused to be compatible with each other as shown in FIG. 11F so that the fixing strength of the picture is substantially equal to the hardness of the surface resin layer 52*b*.

In a manner stated above, a transfer process can be carried out with the developing state having high gradation and resolution being maintained, and the transfer rate can become equal to substantially 100%.

Figure 12:
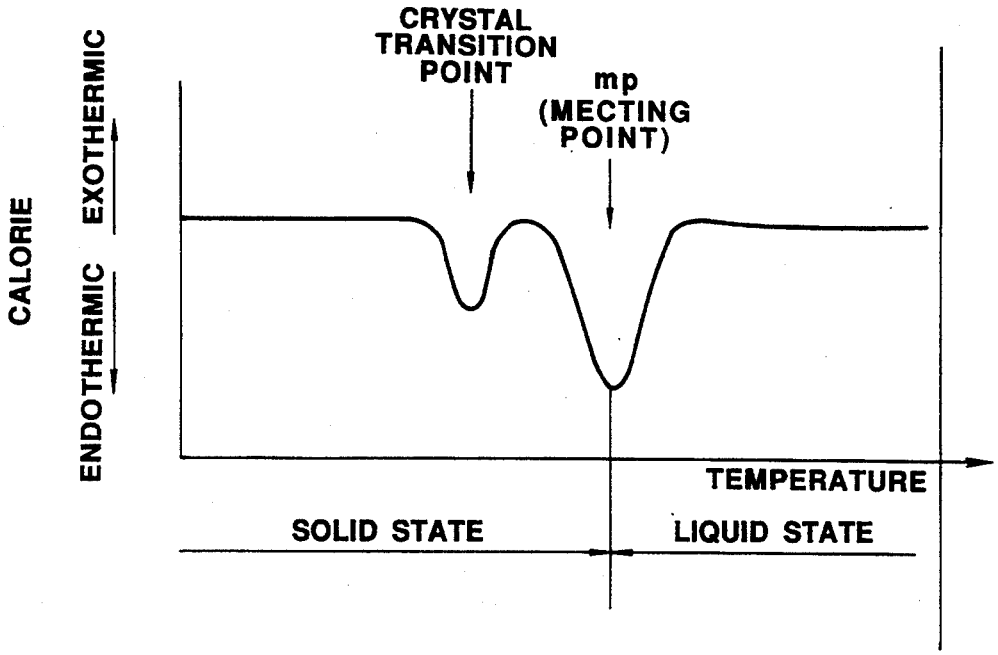
FIG. 12 is a characteristic diagram showing a typical example of a DSC curve obtained by the differential scanning calorimetry.
Figure 13:
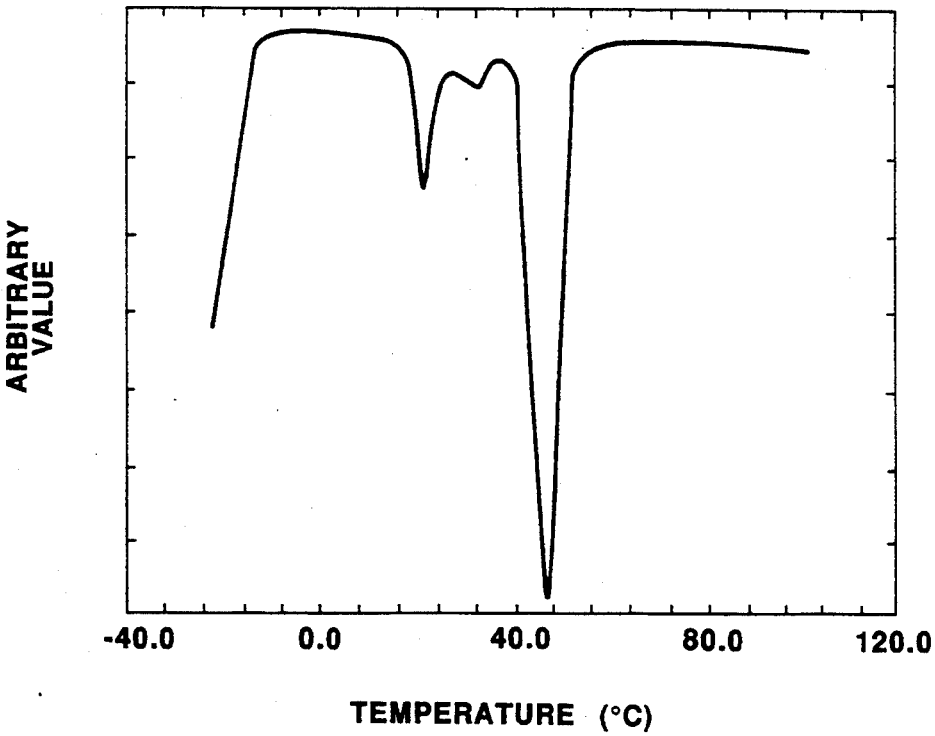
FIG. 13 is a characteristic diagram showing a DSC curve of a wax actually used.

Then, the above-described printer was used to actually carry out a transfer process under various temperature conditions. It is to be noted that the melting point of a dispersion medium of a developer used is determined by the peak of endothermic reaction in the differential scanning calorimeter (DSC) shown in FIG. 12. For example, the DSC chart of a wax used in the following experiment (Trade Name sp0110 by Nippon Seiro Company Ltd.,) is as shown in FIG. 13, and the melting point is 46 degrees.

Further, a developer having a resin layer on the surface thereof and a developing agent having no resin layer thereon were used in transfer. The softening point of the resin layer was measured in accordance with the Vicat softening temperature test method of thermal plastic resin standardized by the Japanese Industrial Standard JIS K7206.

The kind of transfer processes is shown in Table 1, and transfer processes and temperature conditions in respective embodiments are shown in Table 2. It is to be noted that the transfer process is a compatible transfer (fusing) in the case where heating is conducted so that its temperature is above the melting point for convenience irrespective of presence or absence of the surface resin layer of the transfer sheet. The transfer process is an adhesive transfer (softening) in the case where heating is conducted so that its temperature is less than the melting point under the same condition as above. In addition, advantages in the respective embodiments are described together in the Table 2.

TABLE 1

| | | | | MATERIAL | |
|---|---|---|---|---|---|
| SYSTEM | PROCESS | TRANSFER PROCESS | FIXING PROCESS | DEVELOPER | SURFACE RESIN LAYER |
| A | TRANSFER SIMULTANEOUS FIXING PROCESS | COMPATIBLE TRANSFER (FUSION) | NO HEAT TREATMENT | DISPERSION MEDIUM COMPOSITION MELTING POINT Tm | NONE |

TABLE 1-continued

| SYSTEM | PROCESS | TRANSFER PROCESS | FIXING PROCESS | MATERIAL DEVELOPER | MATERIAL SURFACE RESIN LAYER |
|---|---|---|---|---|---|
| B | | ADHESIVE TRANSFER (SOFTENING) | | DISPERSION MEDIUM COMPOSITION MELTING POINT Tm | NONE |
| C | | COMPATIBLE TRANSFER (FUSION) | | DISPERSION MEDIUM COMPOSITION MELTING POINT Tm | RESIN COMPOSITION SOFTENING POSITION Ts |
| D | | ADHESIVE TRANSFER (SOFTENING) | | DISPERSION MEDIUM COMPOSITION MELTING POINT Tm | RESIN COMPOSITION SOFTENING POSITION Ts |
| E | TRANSFER PROCESS + FIXING PROCESS | COMPATIBLE TRANSFER (FUSION) | HEAT TREATMENT | DISPERSION MEDIUM COMPOSITION MELTING POINT Tm | NONE |
| F | | ADHESIVE TRANSFER (SOFTENING) | | DISPERSION MEDIUM COMPOSITION MELTING POINT Tm | NONE |
| G | | COMPATIBLE TRANSFER (FUSION) | | DISPERSION MEDIUM COMPOSITION MELTING POINT Tm | RESIN COMPOSITION SOFTENING POSITION Ts |
| H | | ADHESIVE TRANSFER (SOFTENING) | | DISPERSION MEDIUM COMPOSITION MELTING POINT Tm | RESIN COMPOSITION SOFTENING POSITION Ts |

TABLE 2

| | SYSTEM | CONDITION | FEATURE |
|---|---|---|---|
| EMBODIMENT 1 | A | DEVELOPER MELTING POINT = 70° C.<br>PRESSURE-CONTACT TEMPERATURE = 100° C.<br>PEELING TEMPERATURE = 40° C. | ORDINARY PAPER CAN BE USED.<br>DEVELOPER MELTING POINT IS HIGH. SUFFICIENT FIXING STRENGTH. |
| EMBODIMENT 2 | A | DEVELOPER MELTING POINT = 53° C.<br>PRESSURE-CONTACT TEMPERATURE = 100° C.<br>PEELING TEMPERATURE = 40° C. | ORDINARY PAPER CAN BE USED.<br>PRESSURE-CONTACT TEMPERATURE IS HIGH. |
| EMBODIMENT 3 | A | DEVELOPER MELTING POINT = 46° C.<br>PRESSURE-CONTACT TEMPERATURE = 48° C.<br>PEELING TEMPERATURE = 30° C. | ORDINARY PAPER CAN BE USED.<br>PRESSURE-CONTACT TEMPERATURE CAN BE LOWERED.<br>FIXING STRENGTH IS INSUFFICIENT. |
| EMBODIMENT 4 | B | DEVELOPER MELTING POINT = 70° C.<br>PRESSURE-CONTACT TEMPERATURE = 60° C.<br>PEELING TEMPERATURE = 40° C. | ORDINARY PAPER CAN BE USED.<br>MELTING POINT OF DEVELOPER IS HIGH. |
| EMBODIMENT 5 | B | DEVELOPER MELTING POINT = 46° C.<br>PRESSURE-CONTACT TEMPERATURE = 43° C.<br>PEELING TEMPERATURE = 30° C. | ORDINARY PAPER CAN BE USED.<br>PRESSURE-CONTACT TEMPERATURE CAN BE LOWERED.<br>FIXING STRENGTH IS INSUFFICIENT. |
| EMBODIMENT 6 | F | DEVELOPER MELTING POINT = 46° C.<br>PRESSURE-CONTACT TEMPERATURE = 43° C.<br>PEELING TEMPERATURE = 30° C.<br>HEAT TREATMENT TEMPERATURE = 60° C. | ORDINARY PAPER CAN BE USED.<br>FIXING PROCESS CAN BE INDEPENDENTLY CARRIED OUT.<br>PRESSURE-CONTACT TEMPERATURE CAN BE LOWERED. |
| EMBODIMENT 7 | E | DEVELOPER MELTING POINT = 46° C.<br>PRESSURE-CONTACT TEMPERATURE = 48° C.<br>PEELING TEMPERATURE = 30° C.<br>HEAT TREATMENT TEMPERATURE = 60° C. | SAME AS ABOVE |
| EMBODIMENT 8 | D | DEVELOPER MELTING POINT = 70° C.<br>PRESSURE-CONTACT TEMPERATURE = 60° C.<br>TRANSFERRED BODY = IONOMER (S120)<br>VICAT SOFTENING POINT = 59° C.<br>PEELING TEMPERATURE = 40° C. | COATED PAPER CAN BE USED.<br>DEVELOPER MELTING POINT IS HIGH. |
| EMBODIMENT 9 | D | DEVELOPER MELTING POINT = 46° C.<br>PRESSURE-CONTACT TEMPERATURE = 43° C.<br>TRANSFERRED BODY = VINYL ACETATE COPOLYMER POLYOLEFIN (V100) | COATED PAPER CAN BE USED.<br>PRESSURE-CONTACT TEMPERATURE CAN BE LOWERED.<br>FIXING STRENGTH IS |

TABLE 2-continued

| | SYSTEM | CONDITION | FEATURE |
|---|---|---|---|
| | | VICAT SOFTENING POINT = 40° C.<br>PEELING TEMPERATURE = 30° C. | INSUFFICIENT. |
| EMBODIMENT 10 | C | DEVELOPER MELTING POINT = 46° C.<br>PRESSURE-CONTACT TEMPERATURE = 48° C.<br>TRANSFERRED BODY = VINYL ACETATE COPOLYMER POLYOLEFIN (V100)<br>VICAT SOFTENING POINT = 40° C.<br>PEELING TEMPERATURE = 30° C. | SAME AS ABOVE |
| EMBODIMENT 11 | C | DEVELOPER MELTING POINT = 53° C.<br>PRESSURE-CONTACT TEMPERATURE = 100° C.<br>TRANSFERRED BODY = IONOMER (S120)<br>VICAT SOFTENING POINT = 59° C.<br>PEELING TEMPERATURE = 40° C. | COATED PAPER CAN BE USED.<br>PRESSURE-CONTACT TEMPERATURE IS HIGH.<br>SUFFICIENT FIXING STRENGTH. |
| EMBODIMENT 12 | G | DEVELOPER MELTING POINT = 46° C.<br>PRESSURE-CONTACT TEMPERATURE = 48° C.<br>TRANSFERRED BODY = VINYL ACETATE COPOLYMER POLYOLEFIN (V100)<br>VICAT SOFTENING POINT = 40° C.<br>PEELING TEMPERATURE = 30° C.<br>HEAT TREATMENT TEMPERATURE = 60° C. | COATED PAPER CAN BE USED.<br>FIXING PROCESS CAN BE INDEPENDENTLY CARRIED OUT.<br>PRESSURE-CONTACT TEMPERATURE CAN BE LOWERED.<br>SUFFICIENT FIXING STRENGTH. |
| EMBODIMENT 13 | H | DEVELOPER MELTING POINT = 46° C.<br>PRESSURE-CONTACT TEMPERATURE = 43° C.<br>TRANSFERRED BODY = VINYL ACETATE COPOLYMER POLYOLEFIN (V100)<br>VICAT SOFTENING POINT = 40° C.<br>PEELING TEMPERATURE = 30° C.<br>HEAT TREATMENT TEMPERATURE = 60° C. | SAME AS ABOVE. |

We claim:

1. A method for recording a picture comprising:

a) forming an electrostatic latent image on a base;

b) forming a pictorial image by applying a solidification developer to the base wherein the solidification developer comprises coloring agent particles dispersed in a dispersion medium;

c) cooling the solidification developer forming the pictorial image to a temperature where the dispersion medium is a solid;

d) pressure contacting the solidification developer forming the pictorial image with a transferred body after the cooling step;

e) heating the solidification developer forming the pictorial image to a temperature sufficient to at least soften the dispersion medium to a softened condition so that the solidification developer is in the softened condition during the pressure contacting step;

f) cooling the solidification developer forming the pictorial image to a temperature below the melting point of the dispersion medium while the solidification developer is in contact with the transferred body and after the pressure contacting step; and g) separating the transferred body from the base to transfer the pictorial image from a surface of the base to a surface of the transferred body, wherein the base and the transferred body are maintained at different temperatures where the cohesive strength of the solidification developer forming the pictorial image to the transferred body is greater than the cohesive strength of the solidification developer forming the pictorial image to the base.

2. A method according to claim 1 wherein the transferred body further comprises a resin layer compatible with the solidification developer.

3. A method according to claim 2 wherein the resin layer is fused to the solidification developer by heating the solidification developer to a temperature above the melting point of the dispersion medium while in pressure contact with the resin layer on the transferred body.

4. A method according to claim 2 wherein the solidification developer is heated while in pressure contact with the resin layer on the transferred body to a temperature below the melting point of the dispersion medium but sufficient to soften the dispersion medium, the method further comprising the step of fusing the solidification developer to the resin layer after separating the transferred body from the base, wherein fusion is achieved by heating the solidification developer to at least the softening temperature of the resin layer.

5. A method according to claim 1 wherein the solidification developer further comprises a charge donating agent.

6. A method according to claim 5 wherein the solidification developer further comprises metal oxide fine particles.

7. A method according to claim 1 wherein the base is a belt.

* * * * *